US010702897B2

(12) United States Patent
Scharmach

(10) Patent No.: US 10,702,897 B2
(45) Date of Patent: Jul. 7, 2020

(54) METHOD FOR WEAKENING AND REMOVING COKE AND CARBONACEOUS DEPOSITS

(71) Applicant: William J Scharmach, Grand Island, NY (US)

(72) Inventor: William J Scharmach, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 0 days.

(21) Appl. No.: 16/545,762

(22) Filed: Aug. 20, 2019

(65) Prior Publication Data

US 2019/0366395 A1 Dec. 5, 2019

Related U.S. Application Data

(63) Continuation-in-part of application No. 15/720,202, filed on Sep. 29, 2017, now abandoned.

(51) Int. Cl.

| | |
|---|---|
| ***B08B 9/032*** | (2006.01) |
| ***C10B 43/02*** | (2006.01) |
| ***C10G 9/12*** | (2006.01) |
| ***C10G 9/16*** | (2006.01) |
| ***C10B 43/14*** | (2006.01) |

(52) U.S. Cl.

CPC ..... *B08B 9/0328* (2013.01); *C10B 43/02* (2013.01); *C10B 43/14* (2013.01); *C10G 9/12* (2013.01); *C10G 9/16* (2013.01); *C10G 2300/4012* (2013.01)

(58) Field of Classification Search

None

See application file for complete search history.

(56) References Cited

U.S. PATENT DOCUMENTS

| | | | |
|---|---|---|---|
| 4,203,778 | A | 5/1980 | Nunciato et al. |
| 2014/0060586 | A1 | 3/2014 | Hill |

FOREIGN PATENT DOCUMENTS

| | | | |
|---|---|---|---|
| JP | H05156261 | A | 6/1993 |
| JP | 2000219883 | A | 8/2000 |
| WO | 2016/058281 | | 4/2016 |

OTHER PUBLICATIONS

Tari, V., et al., Failure Analysis of Ethylene Cracking Tube. Journal of Failure Analysis and Prevention, 2009. 9(4): p. 316-322.

Czerw, K., et al., Kinetic models assessment for swelling of coal induced by methane and carbon dioxide sorption. Adsorption, 2016. 22(4): p. 791-799.

Larsen, J.W., Sorption of Carbon Dioxide by Coals. Fuel Chemistry Division Preprints, 2003. 48(1): p. 113.

Cai, H., A. Krzywicki, and M.C. Oballa, Coke formation in steam crackers for ethylene production. Chemical Engineering and Processing: Process Intensification, 2002. 41(3): p. 199-214.

Zhang, L., et al., Influence of Temperature on Coal Sorption Characteristics and the Theory of Coal Surface Free Energy. Procedia Engineering, 2011. 26: p. 1430-1439.

(Continued)

*Primary Examiner* — Derek N Mueller

(74) *Attorney, Agent, or Firm* — Iurie A. Schwartz

(57) ABSTRACT

The present invention concerns a method of weakening and removal of coke or carbonaceous material which deposits as a result of thermal cracking of hydrocarbons on the inner walls of coils, piping, tubing, and in general, hydrocarbon processing equipment.

13 Claims, 2 Drawing Sheets

The impact on the hardness of anthracite coal from $CO_2$ exposure at 70°F at various pressures over time.

(56) References Cited

OTHER PUBLICATIONS

Maphala, T. and N.J. Wagner, Effects of CO2 storage in coal on coal properties. Energy Procedia, 2012. 23 (Supplement C): p. 426-438.
Larsen, J.W., The effects of dissolved CO2 on coal structure and properties. International Journal of Coal Geology, 2004. 57(1): p. 63-70.
Schrittesser, B., et al., Rapid Gas Decompression Performance of elastomers—A study of influencing testing parameters. Procedia Structural Integrity, 2016. 2(Supplement C): p. 1746-1754.
Praxair Services, Inc., The SANDJET Service: In-place, Internal Pipeline Cleaning, www.praxair.com/industrialservices, Copyright 2015, PTI, 1-800-PRAXAIR.

The impact on the hardness of anthracite coal from $CO_2$ exposure at 70°F at various pressures over time.

Images of a section of an atmospheric distillation preheater furnace tube before (left) and after (right) exposure to 750 psig $CO_2$ at 70°F for 12 hours.

An example equipment layout for completing coke weakening / removal

METHOD FOR WEAKENING AND REMOVING COKE AND CARBONACEOUS DEPOSITS

CROSS REFERENCE TO RELATED APPLICATION(S)

This application is a Continuation-in-Part of pending U.S. patent application Ser. No. 15/720,202 filed Sep. 29, 2017 and entitled METHOD FOR WEAKENING AND REMOVING COKE AND CARBONACEOUS DEPOSITS.

FIELD OF THE INVENTION

The present invention relates to a method of weakening and removal of coke or carbonaceous material which deposits as a result of thermal cracking of hydrocarbons on the inner walls of coils, piping, tubing, and in general, hydrocarbon processing equipment. The method includes filling the equipment with a pressurized gaseous stream, holding the equipment at pressure for a designated period, and then removing the pressurized gas from the equipment.

DESCRIPTION OF THE RELATED ART

Equipment utilized in petroleum refining often requires routine maintenance as a result of the formation of coke and carbonaceous material within the equipment components and on wall surfaces. As utilized herein, "coke" will be understood to include solid products such as carbon deposits derived from the destructive distillation of materials such low-ash, and low-sulfur bituminous coal, whereas "carbonaceous materials" includes coal, hydrocarbon products, and fossil fuels that contain carbon and hydrogen molecules. The coke deposits reduce effective heat transfer to the process stream and impede flow (or increase in pressure drop through diameter reduction), which can result in an increase in the cost of operation both in pumping and heating. The reduced heat transfer and the insulating properties can result in hot spots generated on the metal tubes leading to potential bulging, warping, and failure. The carburization and the diffusion of carbon into metal may also lead to premature tube failure from reduced ductility and weakening by microstructural fractures.

Furnace heaters are one example of equipment susceptible to coking. The furnace coils can be cleaned through a multitude of different methods, discussed in detail below. These methods include:

a. pigging: abrasion of coke with a studded pig, routed through a pipeline using water pressure;

b. steam-air decoke (SAD): oxidation of the coke by burning with air and a steam quench;

c. spalling: removal of coke by thermal shock through alternately throttling of steam or other heat fluid through a pipe from high to low flow rates;

d. SandJet™: a Praxair/Union Carbide process (U.S. Pat. No. 4,203,778 A), where coke is abraded by flowing an abrasive-laden high-velocity gas stream through the tubing system.

Steam-air decoking is a well-established technology, which dates back to the beginning of the refining industry itself. It can be effective at removing combustible coke material independent of tube structure such as changes in tube size and deformation. It is usually performed by the refinery operators. SAD can take a long time to complete with a typical turnaround of 36 to 48 hours. The length of time is generally required in order to reduce metallurgical damage. It requires capital investment in piping for steam and air. SAD can also struggle with removing of non-combustibles including inorganic materials such as such as clay, calcium, silica, salt, copper, iron, and sulfur compounds. In addition, SAD is a difficult process that requires precision control for optimal burning. There is potential for "runaway" coke combustion and damage or rupture of tubing and equipment if the process is not properly controlled. SAD also produces emissions from the coke combustion including CO, $CO_2$, and $H_2$ that require treatment.

Spalling (or online spalling) on the other hand, requires the oil to be replaced with steam which is flowed at a controlled velocity. The tubes are then cooled causing the coke to "spall off" the inside of the tube due to the changes in thermal expansion between the coke and metal tube walls. Online spalling has several advantages as it can be carried out while the furnace is still in service, and is seen as more environmentally friendly than SAD with fewer emissions. However, spalling is seen as not as effective as other methods, and it may require a subsequent alternative treatment to remove remaining coke deposits. In fact, spalling is sometimes seen as a way to extend the on-stream time before offline cleaning is required. Spalling can potentially damage tubing from repeated expansion and contraction of tubes. Steam velocities also need to be carefully controlled as spalled coke deposits can abrade/erode tubing/piping systems.

Pigging, or hydraulic pigging, utilizes hardened studs that remove coke through mechanical scrapping of the furnace wall. Pigging is capable of removing all types of coke (including noncombustible material) from tubing walls and is generally faster to complete than SAD and spalling, with no harmful gases to generated. Water is generally screened and recycled to reduce overall water usage. The drawbacks for pigging is that the pigs have a set size and tolerance between the pig and the tube walls, which can cause complications in tubing systems with changing diameters and header systems. Pigging can also abrade the tubes and can groove walls resulting in metal loss and weakening of the tube; particularly at U-bends. The water produced is contaminated with the system contents and requires special disposal. Pigging also requires the furnace (or a portion of the furnace) to be placed out of service. Once pigging is complete, the system will need to be dewatered and inerted before it is brought back online.

SandJet™ is a fast cleaning method as compared to pigging and SAD with completion in approximately 12 hours with no emissions or polluted water produced. The process is dry, meaning the furnace can be immediately brought back into service. The process uses a stream of gas, typically nitrogen, to propel cleaning media through the furnace tubing or pipeline at high velocity. The process is generally repeated while monitoring the pressure drop through the system until the desired pressure drop is achieved by removal of the coke deposits from the inner walls. SandJet™ requires the pipe or tube to be "flowable," meaning free of obstructions and demonstrably open for the flow of gas. The process may require a pretreatment such as steam or nitrogen drying the furnace and/or a swab pig or wire brushes to dry the pipes. SandJet™ though has difficulty tackling "hard" and vicious cokes and in a similar manner to pigging requires the furnace (or a portion thereof) to be taken offline. The process results in a minimal metal loss and can affect surface polishing which reduces subsequent coke formation.

The present invention utilizes sorption of gas into the coke in order to weaken and spall the coke from the wall face. As utilized herein, the term "sorption" shall mean the physical and chemical process by which one substance becomes attached to another and is seen as the concomitant phenomenon of absorption and adsorption. The term "adsorption" is used to describe the physical adhesion of molecules to the surface of another, while the term "absorption" is used to describe the physical uptake of molecules into the volume of another or the dissolution of molecules within another phase. "Dissolution" is the process by which a substance forms a solution in a solvent (in this case a solid solvent). Carbon-based materials such as coal have shown an affinity for uptake of gases such as methane and $CO_2$. This is particularly relevant for coal materials in the application of $CO_2$ sequestration, as adsorption and dissolution of $CO_2$ into the coalbed causes significant mechanical changes within the coal structure including swelling and plasticizing. It has been found that these and similar mechanical effects can be leveraged in a decoking operation and used to remove or aid in the removal of coke from the walls of furnace tubes and other refinery equipment.

The process as described herein is similar to the technique of spalling and can also be completed while the system is online. The process may be seen more attractive in certain scenarios as compared to traditional online spalling as the process fluid is replaced with a "dry gas" rather than steam; eliminating a post-dewatering step. In the same manner, it can also be used to maintain the operability of a system before a more thorough decoking is required. The process may also be better suited for preserving inhibiting oxide layers such as $Cr_2O_3$ which reduce coke formation, tube carburization, and thermal shock. Mechanical erosion may result in its removal and increased likelihood and severity and of coke formation and tube failure. The key difference is that the expansion and breakdown of coke from traditional spalling is the result of heating, whereas the present invention employs the sorption of gas to achieve the same result. The valves and lines provided must also be able to sustain the pressures required for adequate coke uptake of gas.

Generally, for adsorption mechanisms (especially as compared to $CO_2$ sorption in coal), lower temperatures and higher pressures improve $CO_2$ adsorption volumes, meaning a cold, high-pressure gas is best suited for sifting the equilibria for greater uptake of $CO_2$ by the coal. The swelling mechanism, however, is driven by dissolution and in a similar fashion, the amount of $CO_2$ that is dissolved also increases with pressure. If confined, the swelling creates stain through compression. This strain has resulted in a plasticizer behavior in coals and with the resulting changes in volume can lead to mechanical failure. By quick decompression of the treatment gas, further failures are allowed to occur including initiation and growth of fractures and fragmentation of bulk material.

Other objects and aspects of the present invention will become apparent to one skilled in the art upon review of the specification, drawings and claims appended hereto.

SUMMARY OF INVENTION

The present invention is a method for the removal of coke or other carbon-based deposit in a pressurizable enclosure by exposure to a gas under pressure for an extended period of time, followed by depressurization of the enclosure. Specifically, one aspect of the invention provides a method for weakening and removal coke or other carbonaceous deposits on the inner walls of coils, piping, tubing, and other general hydrocarbon processing equipment by exposing said equipment to a pressurized stream of gas, allowing sorption of gas into the coke, and then depressurizing the coke of said gas. The pressure of said treatment gas is generally in the range of about 50 and 5,000 psig.

The treatment gas utilized in the method includes carbon dioxide, and alternatively, carbon dioxide mixtures. These mixtures include:

a. Carbon dioxide in some portion of the treatment gas (above 1% by mass) and, b. A secondary component gas consisting of one or more of the following:

i. Methane or higher hydrocarbon ii. Hydrogen iii. Nitrogen iv. Oxygen

The method optionally includes a means of removing weakened or dislodged material from the equipment, such as:

Flowing a gas stream, such as nitrogen, through the apparatus;

Pressurizing and depressurizing with nitrogen gas;

Performing a SandJet or other mechanical cleaning operation on the equipment.

BRIEF DESCRIPTION OF THE DRAWINGS

The objects and advantages of the invention will be better understood from the following detailed description of the preferred embodiments thereof in connection with the accompanying figures wherein like numbers denote same features throughout and wherein.

DETAILED DESCRIPTION OF THE INVENTION

The present invention concerns a method for weakening and removal of carbonaceous material and coke inclusive of a two-step process of pressurization followed by depressurization. The process can be repeated as necessary in order to maximize the result.

The system/equipment must be able to hold gas at a pressure substantially higher than ambient pressure. This may necessitate the installation of pressure isolation valving or various ports capped and plugged in order to retain the integrity of the treatment gas within the target system. The system is then filled with the treatment gas at pressures ranging from about 50 to 5,000 psi, and may be either isolated or continually attached to the treatment gas source in order to maintain system pressure as the gas is sorbed into the coke deposits. After a set period of time, the treatment gas is released, and a subsequent flow of gas or liquid may be used to remove any deposits that have become dislodged from the wall.

Figure 1:
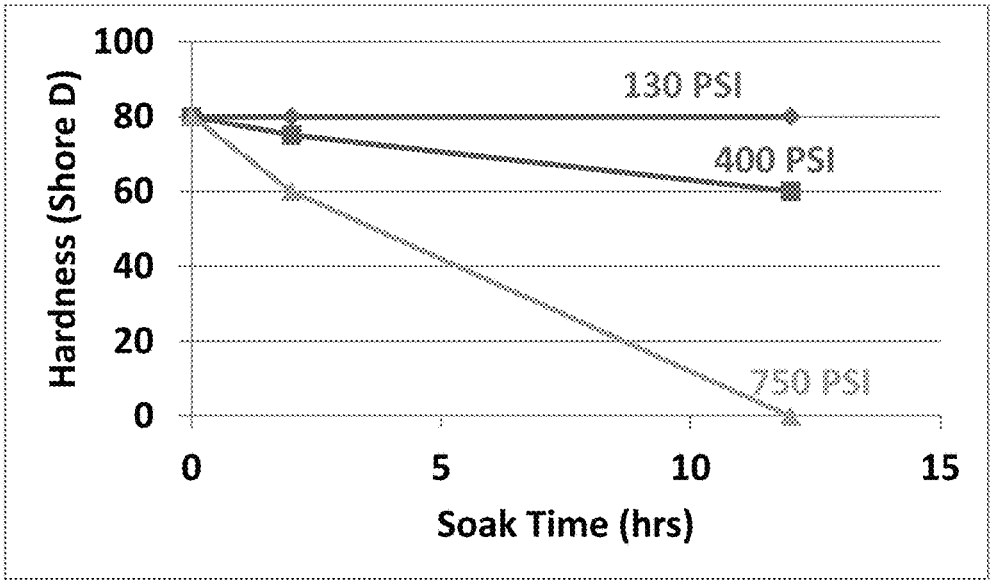
FIG. 1 is a graph illustrating the impact on the hardness of anthracite coal from $CO_2$ exposure at various pressures.

An example and resulting impact of such treatment is shown in FIG. 1 using anthracite coal. The treatment gas, in this example, approximately 100% $CO_2$, was injected into the system in a vapor state. A liquid state can also be used, but economics favor a vapor treatment. The treatment was carried out at ambient temperature (70° F.) generally which eliminates the need for heating and cooling during treatment. The system was filled with $CO_2$ at pressures of 130, 400, and 750 psi. At 750 psi, this is the pressure which is close to, but below the condensation pressure of $CO_2$ at ambient temperature. The hardness of the anthracite coal was measured using a durometer before and after exposure with the starting hardness of the coal estimated to be around 80 on the Shore D scale. A reduction in hardness correlates to the highest sorption volumes which is achieved by long soak times at high pressures. Therefore samples exposed to the highest pressures for the longest periods of time resulted in the greatest reduction in hardness and were most easily friable. Although this example has been done in relation to $CO_2$ and other gases such as methane, higher hydrocarbons, oxygen, nitrogen, and mixtures thereof can be utilized. Preferably, the gas predominantly carbon dioxide in a concentration of anywhere from 1 to 100%, more preferably at a concentration of 50% and above. Where the carbon dioxide is less than 100% it is a mixture with a secondary gas component in a concentration of 0 to 99%, wherein the secondary gas is selected from methane, higher hydrocarbon, hydrogen, nitrogen, and oxygen.

Figure 2:
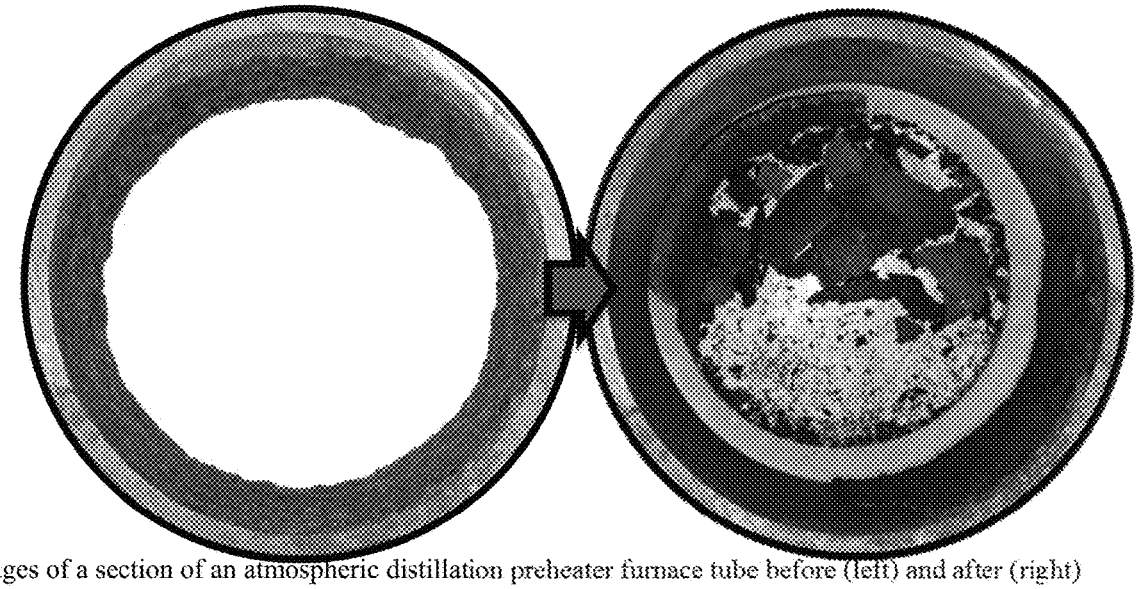
FIG. 2 shows the removal of coke from a coked furnace tube from an atmospheric distillation unit before and after 12 hours of $CO_2$ exposure at 750 psi.

FIG. 2 shows a similar treatment of an 8-inch pipe segment from an atmospheric distillation pre-heater or furnace. The sample was treated at ambient temperature for 12 hours at a pressure of 750 psig. The image on the left depicts the pipe segment before treatment, while the image on the right is the pipe segment after treatment and a significant portion of the coke deposit removed from the pipe segment. No subsequent treatment was used in the removal of the coke layer from the pipe walls. The example treatment was able to remove 84.3% by mass of coke from the tube walls. The remainder of the coke material, which has been weakened at this stage, can be removed by a subsequent step of either pigging, SAD, spalling or SandJet™, as mentioned above.

Figure 3:
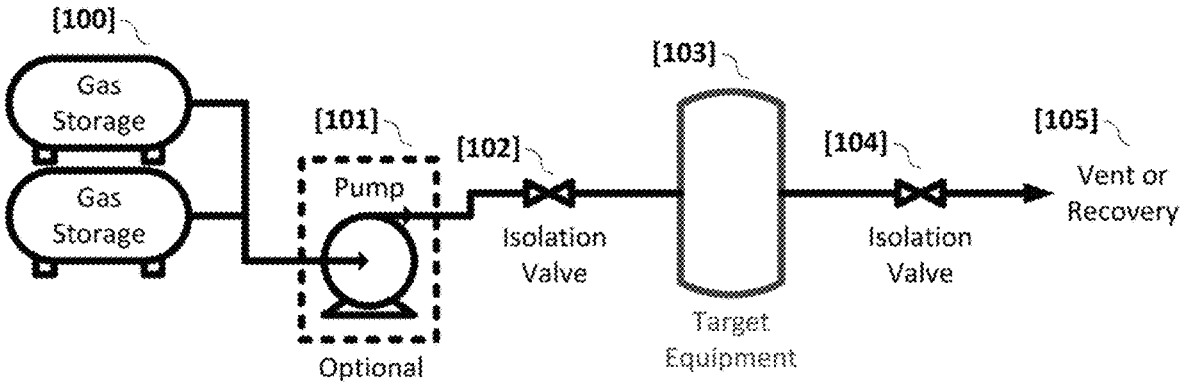
FIG. 3 is an exemplary embodiment of the process schematic of the present invention.

FIG. 3 shows an exemplary embodiment of the method described. The system includes $CO_2$ and potentially another gas 100 that is used to feed an optional pump 101. The pump 101 is used to bring the gas to treatment pressure if the gas source 100 is not already. Otherwise, the pump may be excluded from treatment. It is assumed that the equipment targeted for treatment 103 is at an already low-pressure state, likely atmospheric pressure. The gas flows from the source 100 to the target equipment 103 via an optional isolation valve 102. Isolation valve 104 is closed to prevent any of the treatment gas from leaving the target equipment 103. Once the target equipment is at treating pressure, the equipment may be isolated from the source using isolation valve 103 or left in fluidic contact with the equipment in order to maintain pressure as gas is sorbed into the coke material. After a set time (generally around 6 to 12 hours) the gas is relieved quickly (generally less than 1 hr) from the target equipment 103 via isolation valve 104. The gas source prior to venting is either isolated using isolation valve 103 or removed from the process. These steps can be repeated as necessary until the desired results are achieved.

Although various embodiments have been shown and described, the present disclosure is not so limited and will be understood to include all such modifications and variations as would be apparent to one skilled in the art.

I claim:

1. A method for the weakening of coke or other carbonaceous deposits on inside walls of coils, piping, tubing, and other general hydrocarbon processing equipment comprising: exposing said inside walls of coils, piping, tubing, and other general equipment to a pressurized gas, sealing and pressurizing said coils, piping, tubing, and other general hydrocarbon processing equipment, allowing sorption of gas into the coke or other carbonaceous deposit, and then depressurizing the inside walls of coils, piping, tubing, and other general equipment and contents of said gas, wherein said gas includes carbon dioxide in a concentration of 50% and above.

2. The method of claim 1, wherein the pressure of the gas stream is in a range between about 50 and 5,000 psi.

3. The method of claim 1, wherein the gas is a mixture containing carbon dioxide and one or more secondary component gases.

4. The method of claim 3, wherein the secondary component gas is selected from methane or a higher hydrocarbon.

5. The method of claim 3, wherein the secondary component is gas is hydrogen.

6. The method of claim 3, wherein the secondary component gas includes oxygen.

7. The method of claim 3, wherein the secondary component gas includes nitrogen.

8. The method of claim 1, wherein the gas and/or the coke or other carbonaceous deposit is heated above ambient temperature during the treatment.

9. The method of claim 1, wherein depressurization is at sufficient rate to remove loosened deposits from a furnace.

10. The method of claim 1, comprising the additional subsequent step of passing a flow of gas through the equipment to sweep loosened deposits from the equipment.

11. The method of claim 1, comprising the additional subsequent step of performing mechanical cleaning treatment to remove weakened deposits from equipment.

12. The method of claim 11 wherein the mechanical cleaning treatment is completed by flowing an abrasive-laden high velocity gas stream through the equipment.

13. The method of claim 11 wherein the mechanical cleaning treatment is completed by pigging.

* * * * *